US006385411B1

(12) United States Patent
Anthony et al.

(10) Patent No.: US 6,385,411 B1
(45) Date of Patent: May 7, 2002

(54) DENSITOMETER DIAGNOSTIC SYSTEM FOR AN IMAGE-FORMING MACHINE

(75) Inventors: James D. Anthony, Victor; Kenneth M. Patterson, Hilton; William A. Hameister, Penfield, all of NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/687,647

(22) Filed: Oct. 13, 2000

(51) Int. Cl.[7] ..... G03G 15/00
(52) U.S. Cl. ..... 399/74; 250/341.8; 399/9
(58) Field of Search ..... 399/74, 46, 48, 399/49, 9; 250/341.8, 559.01, 559.39

(56) References Cited

U.S. PATENT DOCUMENTS 5,678,132 A * 10/1997 Shiba et al. ..... 399/59
5,773,827 A * 6/1998 Yazdy et al. ..... 250/341.8
5,903,800 A 5/1999 Stern et al. ..... 399/74
6,229,972 B1 * 5/2001 Rushing ..... 399/74

* cited by examiner

*Primary Examiner*—Sophia S. Chen
(74) *Attorney, Agent, or Firm*—Richard K. Clark

(57) ABSTRACT

The invention provides a diagnostic system for a densitometer in an image-forming machine. An image-forming machine with a densitometer diagnostic system may have a photoconductor, one or more chargers, an exposure machine, a toning station, and a densitometer. A densitometer diagnostic system for an image-forming machine may have an emitter, a collector, amplifier circuitry, and diagnostic circuitry. The diagnostic circuitry reduces the drive current to the emitter in the densitometer by a known or calculable value. The output voltage from the amplifier circuitry in the densitometer is reduced in proportion to the reduction in the drive current. To perform diagnostic testing of the densitometer, a first output voltage is obtained from the densitometer without the diagnostic circuitry connected. A second output voltage is obtained from the densitometer with the diagnostic circuitry connected. When the difference in first and second output voltages matches an output voltage specification, the densitometer is functional. The diagnostic circuitry may be removed from the densitometer when not in use. Alternatively, the densitometer may have a switch to disconnect the diagnostic circuitry when not in use.

39 Claims, 7 Drawing Sheets

DENSITOMETER DIAGNOSTIC SYSTEM FOR AN IMAGE-FORMING MACHINE

FIELD OF THE INVENTION

This invention relates generally to image-forming machines with densitometers. More particularly, this invention relates to diagnostic systems for densitometers used in electrophotographic image-forming machines.

BACKGROUND OF THE INVENTION

Image-forming machines are used to transfer images onto paper or other medium. Generally, a photoconductor is selectively charged and optically exposed to form an electrostatic latent image on the surface. Toner is deposited onto the photoconductor surface. The toner is charged, thus adhering to the photoconductor surface in areas corresponding to the electrostatic latent image. The toner image is transferred to the paper or other medium. The paper is heated for the toner to fuse to the paper. The photoconductor is then refreshed—cleaned to remove any residual toner and charge—to make it ready for another image.

Many image-forming machines use a densitometer to assist operating and controlling the image-forming process. The densitometer has an emitter and a collector on opposite sides of the photoconductor. In a transmission densitometer, the optical path passes from the emitter through the photoconductor to the collector. The densitometer provides a voltage reading corresponding to the amount of light energy passing from the emitter to the collector. The voltage reading also corresponds to the density of the photoconductor and any toner on it. By comparing a voltage reading of the photoconductor to a voltage reading of the photoconductor with toner, a net voltage reading may be obtained that is indicative of the toner on the photoconductor. The densitometer typically works with a process patch, which is on the surface of the photoconductor in an interframe or edge area. As the image-forming machine operates, the process patch is charged, exposed, and developed to provide the maximum toner density on the process patch. The densitometer determines the optical density of toner on the process patch, from which operating adjustments are made.

Generally, an optical filter is used to determine the performance of the densitometer. A portion of the photoconductor, without toner, is positioned in the optical path of the densitometer. A voltage reading of the photoconductor is taken. The optical filter is attached to a wand and projected into the image-forming machine so the optical filter blocks the optical path of the densitometer. The optical filter reduces a predetermined amount of light energy passing through the photoconductor to the collector. A voltage reading of the photoconductor with the filter is compared to the voltage reading of the photoconductor without the filter. If the difference in the voltage readings is within a particular range for the filter, the densitometer is deemed to be operating within specifications.

The optical filter is difficult to use and provides subjective voltage readings. When projecting the filter and wand into the image-forming machine, care must be taken not to damage other parts and not to scratch or mark the filter and the photoconductor. Additionally, care must be taken to position the optical filter properly in front of the emitter. The filter may be held at an angle in relation to the emitter. The filter may be held too close or too far from the emitter. The filter may be moved while the voltage reading is taken. There may be additional variability from the experience level of the person performing the diagnostic procedure. In addition, the optical filter and wand are rather awkward pieces of equipment to carry. The filter also must be protected from damage when not in use.

Accordingly, there is a need for densitometer diagnostic systems in image-forming machines that have greater reliability and ease of use.

SUMMARY

This invention provides a diagnostic system for a densitometer in an image-forming machine. The densitometer diagnostic system has diagnostic circuitry that reduces the drive current to the emitter in the densitometer by a known or calculable value. The output voltage from the amplifier circuitry in the densitometer is reduced in proportion to the reduction in the drive current. The densitometer output voltage with the diagnostic circuitry is compared to the densitometer output voltage without the diagnostic circuitry. The difference in the output voltages is compared to an output voltage specification associated with the diagnostic circuitry. When the difference in the output voltages essentially matches or is essentially within the range of the output voltage specification, the densitometer is functioning within specifications.

An image-forming machine with a densitometer diagnostic system may have a photoconductor, one or more chargers, an exposure machine, a toning station, and a densitometer. The chargers, exposure machine, and toning station, are positioned adjacent to the photoconductor. The charger or chargers electrostatically charges the photoconductor. The exposure machine optically exposes and forms an electrostatic image on the photoconductor. The toning station applies apply toner on the photoconductor. The toner has a charge to adhere to the electrostatic image.

The densitometer may have an emitter, a collector, amplifier circuitry, and diagnostic circuitry. The emitter and a collector are positioned adjacent to the photoconductor. The collector collects emissions from the emitter. The amplifier circuitry provides a voltage supply to the emitter and receives a current signal from the collector. The amplifier circuitry provides at least one output voltage based on the current signal. The diagnostic circuitry is connected to the amplifier circuitry and the emitter. The diagnostic circuitry reduces the drive current to the emitter.

A densitometer diagnostic system for an image-forming machine may have an emitter, a collector, amplifier circuitry, and diagnostic circuitry. The collector is positioned to collect emissions from the emitter. The amplifier circuitry provides a voltage supply to the emitter and receives a current signal from the collector. The amplifier circuit provides an output voltage based on the current signal. The diagnostic circuitry is connected to the amplifier circuitry and the emitter. The diagnostic circuitry reduces the drive current to the emitter.

In a method for diagnostic testing of a densitometer in an image-forming machine having a photoconductor, a first output voltage is obtained from the densitometer for the photoconductor. The diagnostic circuitry is connected to the densitometer. A second output voltage is obtained from the densitometer for the photoconductor. An output voltage difference from the first and second output voltages is determined. The output voltage difference is compared to an output voltage specification.

In an alternate method for diagnostic testing of a densitometer in an image-forming machine having a photoconductor, the diagnostic circuitry is connected to the densitometer. A first output voltage is obtained from the densitometer for the photoconductor. The diagnostic circuitry is disconnected from the densitometer. A second output voltage is obtained from the densitometer for the photoconductor. An output voltage difference is determined from the first and second output voltages. The output voltage difference is compared to an output voltage specification.

Other systems, methods, features, and advantages of the invention will be or will become apparent to one skilled in the art upon examination of the following FIGS. and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

FIGS. 3A, 3B, and 3C show various views of an embodiment of the diagnostic circuitry: in which FIG. 3A is a longitudinal side of the diagnostic circuitry; FIG. 3B is a first end view of the diagnostic circuitry; and FIG. 3C is a second end view of the diagnostic circuitry.

DETAILED DESCRIPTION OF THE PREFERRED EMBODIMENTS

Figure 1:
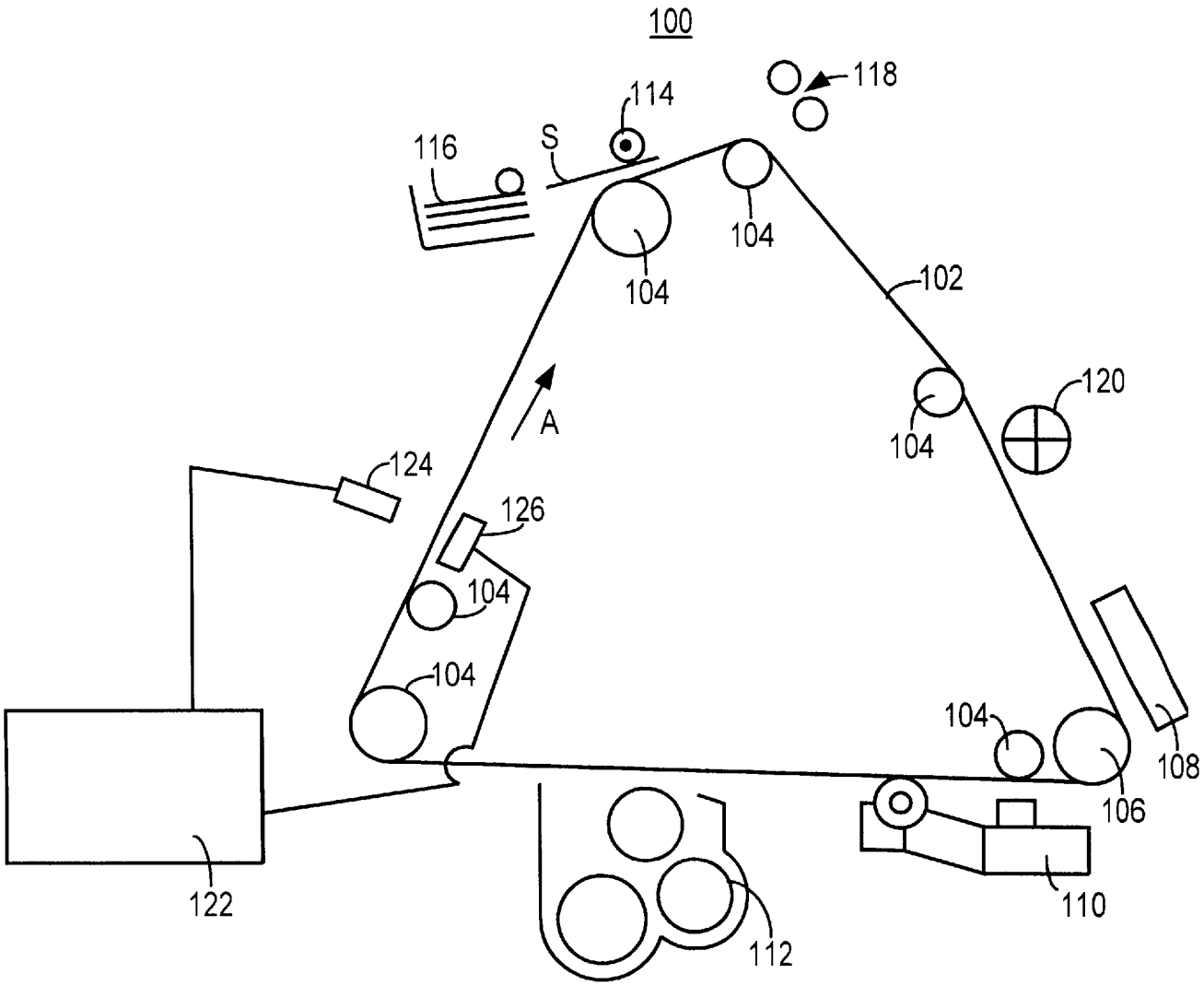
FIG. 1 is a block diagram of an image-forming machine having a densitometer diagnostic system.

FIG. 1 is a block diagram of an image-forming machine 100 having a densitometer 122 with a diagnostic system. A photoconductor 102 is operatively mounted on support rollers 104. A motor driven roller 106 moves the photoconductor 102 in the direction indicated by arrow A. A primary charger 108, an exposure machine 110, a toning station 112, a transfer charger 114 having a paper or media feeder 116, a fusing station 118, and a cleaner 120 are operatively disposed adjacent to the photoconductor 102. The densitometer 122 has an emitter 124 and a collector 126, which are operatively disposed next to the photoconductor 102. The densitometer 122 also includes diagnostic circuitry (not shown). Preferably, the photoconductor 102 has a belt and roller-mounted configuration. The photoconductor 102 may be mounted using a drum or other suitable configuration. While particular configurations and arrangements are shown for the image-forming machine 100, other configurations and arrangements may be used including those with additional components such as a logic and control unit (LCU).

Figure 2:
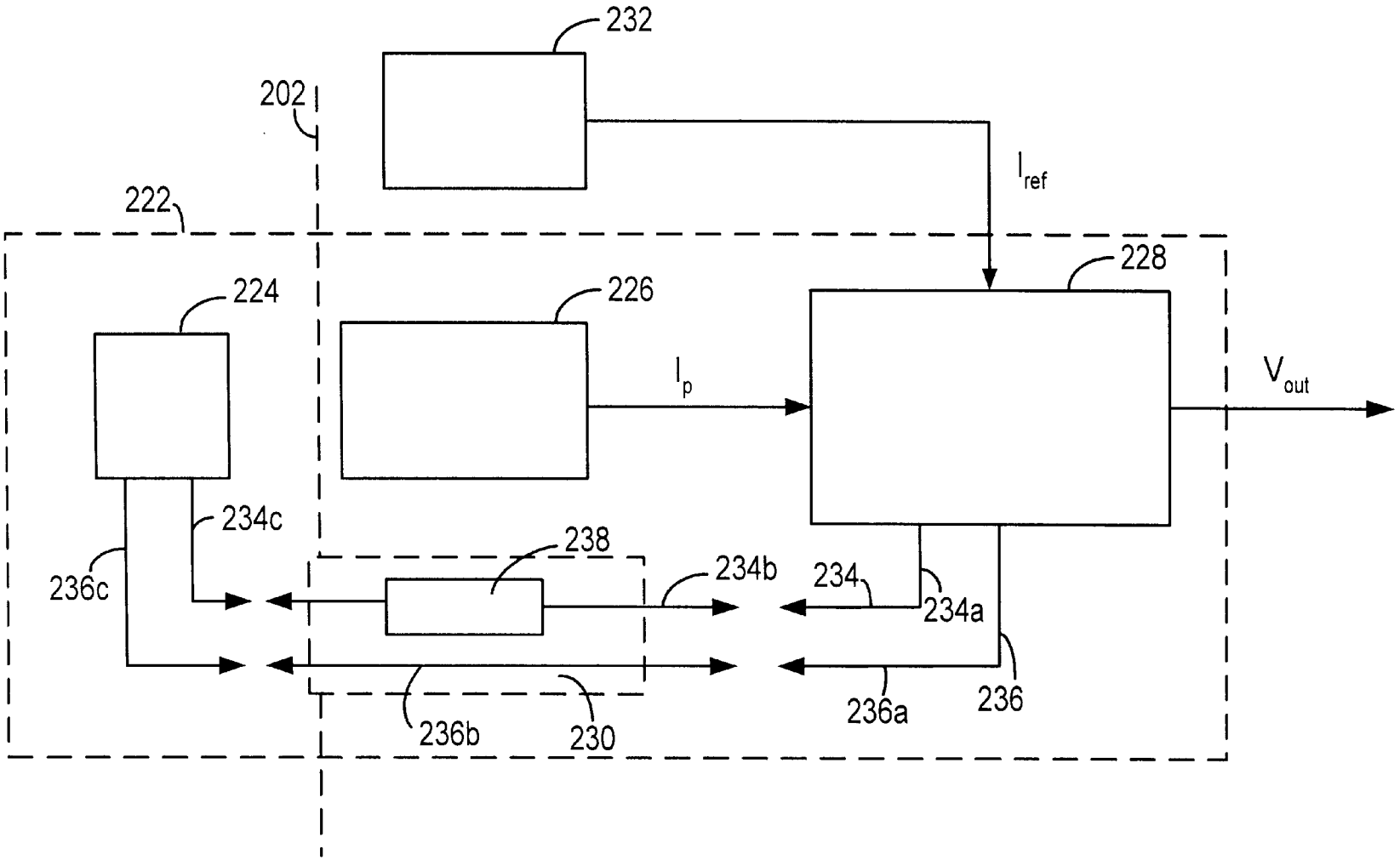
FIG. 2 is a block diagram of a densitometer having a diagnostic system according to a first embodiment.

FIG. 2 is a block diagram of a densitometer 222 having a diagnostic system according to a first embodiment. The densitometer 222 comprises amplifier circuitry 228, diagnostic circuitry 230, an emitter 224, and a collector 226. While a transmission densitometer is illustrated, a reflection densitometer or other optical density-measuring device may be used. A current source 232, which may be part of the densitometer 222, provides a reference current $l_{ref}$ to the amplifier circuitry 228.

The amplifier circuitry 228 comprises a logarithmic and log ratio amplifier (not shown). Other and additional amplifiers may be used. The amplifier circuitry 30 228 preferably includes a first current limit resister (not shown) to limit the current supply to the emitter 224. The amplifier circuitry 228 compares a current signal $I_p$ from the photodiode 226 with the reference current $I_{ref}$ from the current source 232. The amplifier circuitry 228 provides an output voltage $V_{out}$ to the logic and control unit (LCU). Another microprocessor may be used. The output voltage $V_{out}$ corresponds to the density of the photoconductor 202. The LCU may display the output voltage $V_{out}$ as received and may convert the output voltage $V_{out}$ into a different form or representation. The LCU may store the output voltage $V_{out}$ for later retrieval.

Preferably, amplifier circuitry 228 provides a voltage supply to the emitter 224 through a first wire 234 and a second wire 236. Each of the wires 234 and 236 has a first segment 234*a* and 236*a*, a second segment 234*b* and 236*b*, and a third segment 234*c* and 236*c*, respectively. A separate voltage supply source (not shown) may supply voltage to the emitter 224.

The emitter 224 provides emissions such as infrared, visible light, and the like. Preferably, the emitter is an infrared emitting diode (IRED). The emitter 224 may be a light emitting diode (LED) or other suitable emission device. The emitter 224 preferably is made of GaAlAs, although other suitable materials may be used. Preferably, the emitter 224 has a wavelength in the range of about 850 nm through about 950 nm. In one aspect, the wavelength of the emitter 224 is selected depending upon the type of photoconductor 202.

The collector 226 is configured to operate with the emitter 224. In one aspect, the collector 226 is a photodiode. Preferably, the collector 226 is a silicon photodiode. The collector 226 may comprise an operational amplifier (not shown). The collector 226 provides the current signal Ip to the amplifier circuitry 228.

In use, the emitter 224 provides infrared, visible light, or other emissions, which pass through the photoconductor 202. The collector receives these emissions and provides a current signal $l_p$, to the amplifier circuitry 228. The current signal $I_p$ corresponds to the energy collected and hence the optical density of the photoconductor 202.

The diagnostic circuitry 230 may be any suitable electrical or solid-state circuitry for reducing the drive current to the emitter 224 by a known or calculable value, which may have a margin of error. The power output of the emitter 224 reduces in proportion to the reduction in the drive current. The collector 226 in turn receives a lower amount of energy in proportion to the reduction in the power output of the emitter 224. The collector 226 provides a lower current signal in proportion to the lower amount of received energy. Accordingly, the output voltage from the amplifier circuitry 228 is reduced in proportion to the reduction in the drive current provided by the diagnostic circuitry 230.

The output voltage when the diagnostic circuitry 230 is connected is compared to the output voltage when the diagnostic circuitry 230 is not connected. Preferably, these output voltages are obtained for the same location on the photoconductor 202. Preferably, the photoconductor 202 is without toner at this location. The difference in the output voltages is compared to an output voltage specification associated with the diagnostic circuitry 230. The output voltage specification is a value or range of values of what the difference output voltages would be if the densitometer is operating within specifications—the output voltage essentially matches or is essentially within the range of output voltage specification. Preferably, the diagnostic circuitry 230 reduces the drive current in the range of about 35 percent through 65 percent. In one aspect, the diagnostic circuitry 230 reduces the power output of the emitter 224 by about 50 percent.

The diagnostic circuitry 230 in this embodiment comprises a second current limiting resistor 238, the second segment 234*b* of the first wire 234, and the second segment 236*b* of the second wire 236. The second current limiting resistor 238 preferably is a single resister and may be multiple resisters and any suitable current limiting circuitry. The second segment 236*b* is a bridge wire to span the "gap" between the first and third segments 236*a* and 236*c* of the second wire 236. Preferably, the second limiting resister 238 has a resistance in the range of about 100 Ω through about 200 Ω and operates in the range of 0.25 W through about 2 W. In one aspect, the second current limiting resister 238 is about 150 Ω and about 0.5 W.

The second current limiting resister 238 is different from the first current limiting resister in the amplifier circuitry 228. The first current limiting resister keeps the current level below the current burnout level of the emitter. The second current limiting resister 238, in one aspect, reduces the current drive to the emitter below the current burnout level, effectively providing an "electrical replacement" of a toned patch, an optical filter, and similar diagnostic systems. A variable resistance resister may be configured to "act" as the first and second current limiting resisters, however, the variable resistance resister needs to be suitably accurate to provide the proper current reductions.

The diagnostic circuitry 230 may have cap and plug connectors (not shown) for connecting the second segments 234*b* and 236*b* to the first segments 234*a* and 236*a* and for connecting the second segments 234*b* and 236*b* to the third segments 234*c* and 236*c*. The wires 234 and 236 may be part of the same cable. A single cap connector (not shown) for the second segments 234*b* and 236*b* may connect to a single plug connector (not shown) for the first segments 234*a* and 236*a*. Similarly, another single plug connector (not shown) for the second segments 234*b* and 236*b* may connect to another single cap connector (not shown) for the third segments 234*c* and 236*c*.

Figure 3C:
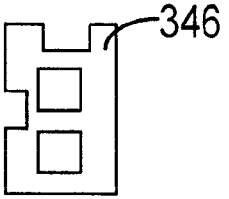
Figure 3A:
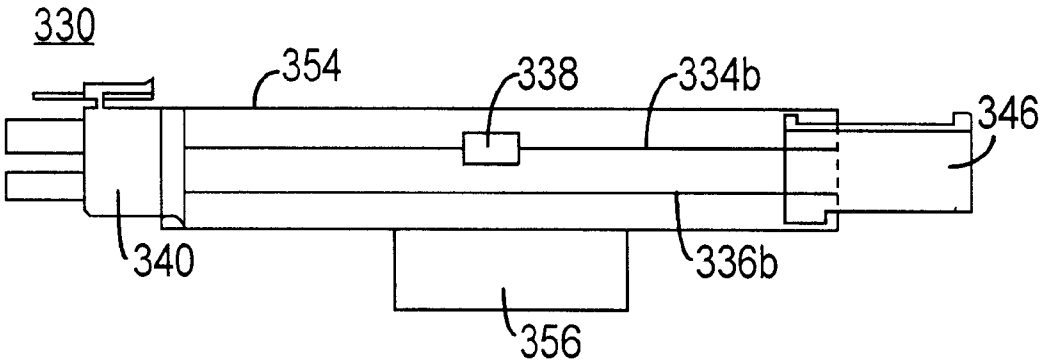
Figure 3B:
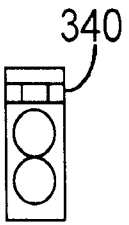

FIGS. 3A, 3B, and 3C show various views of an embodiment of the diagnostic circuitry 330. The diagnostic circuitry 330 comprises a second current limiting resistor 338, second wire segments 334*b* and 336*b*, a plug connector 340, a cap connector 346, and a sleeve 354. The diagnostic circuitry 330 may have an identification (ID) label 356. The plug connector 340 connects with another cap connector (not shown) on third wire segments (not shown). Similarly, the cap connector 346 connects with another plug connector (not shown) on first wire segments (not shown). The sleeve 354 preferably is shrink plastic, but may be made from any other material suitable to dissipate heat and protect the diagnostic circuitry 330.

The plug and cap connectors 340 and 346 may be any connectors suitable for connecting the diagnostic circuitry 330 to a densitometer. The plug connector 340 and the cap connector 346 may be reversed. Also, the diagnostic circuitry 330 may have two plug connectors or two cap connectors rather than a plug connector and a cap connector. In this case, an adaptor (not shown) may be necessary to connect the first and third wire segments when the diagnostic circuitry is not used. In one aspect, the plug connector 340 and the cap connector 346 each connect to both second wire segments 334*b* and 336*b*. However, each second wire segment 334*b* and 336*b* may have individual cap and plug connectors.

In FIG. 2, the diagnostic circuitry 230 preferably is removed from the densitometer 222 when no diagnostic testing is performed. The first segments 234*a* and 236*a* disconnect from the third segments 234*c* and 236*c*. Single or multiple cap connectors and plug connectors may be used as described in FIG. 3. One or more adaptors (not shown) may be used if only plug connectors or only cap connectors are used to connect the wire segments.

When diagnostic testing of the densitometer 222 is performed, a portion of the photoconductor 202 without toner is positioned in the optical path of the emitter 224 and the collector 226. The photoconductor 202 may have toner, but the readings will not be as accurate. A first output voltage $V_{out1}$ reading of the photoconductor is obtained and subsequently recorded or stored. The diagnostic circuitry 230 is connected to the densitometer 222. The first segments 234*a* and 236*a* connect to the second segments 234*b* and 236*b*, respectively. The third segments 234*c* and 236*c* connect to the second segments 234*b* and 236*b*, respectively. If the embodiment in FIG. 3 or a similar embodiment is used, the appropriate cap and plug connectors are aligned and pushed together. A second output voltage $V_{out2}$ reading of the photoconductor 202 is obtained and subsequently recorded or stored. The diagnostic circuitry 230 reduces the current drive to the emitter 224, effectively creating an "electrical version" of the optical filter, the toner patch, and the like diagnostic systems.

The first output voltage $V_{out1}$ reading is compared to the second output voltage $V_{out\ 2}$reading. Preferably, the first output voltage $V_{out1}$ reading is subtracted from the second output voltage $V_{out2}$ reading to provide an output voltage difference $V_{diff}$ reading. The user may perform this calculation. Alternatively, the LCU may perform this calculation and may display and store the result. The output voltage difference $V_{diff}$ reading is compared to an output voltage specification that signifies the densitometer components are functional. The output voltage specification may be a particular value or range of values and depends upon the densitometer and the diagnostic circuitry used.

The diagnostic circuitry 230 is disconnected from the densitometer 222. The first segments 234*a* and 236*a* disconnect from the second segments 234*b* and 236*b*, respectively. The third segments 234*c* and 236*c* disconnect from the second segments 234*b* and 236*b*, respectively. If the embodiment in FIG. 3 or a similar embodiment is used, the appropriate cap and plug connectors are pulled apart. The first segments 234*a* and 236*a* are reconnected to the third segments 234*c* and 236*c*, respectively. Alternatively, the first output voltage reading $V_{out1}$ may be taken after the diagnostic circuitry is disconnected from the densitometer.

Figure 4:
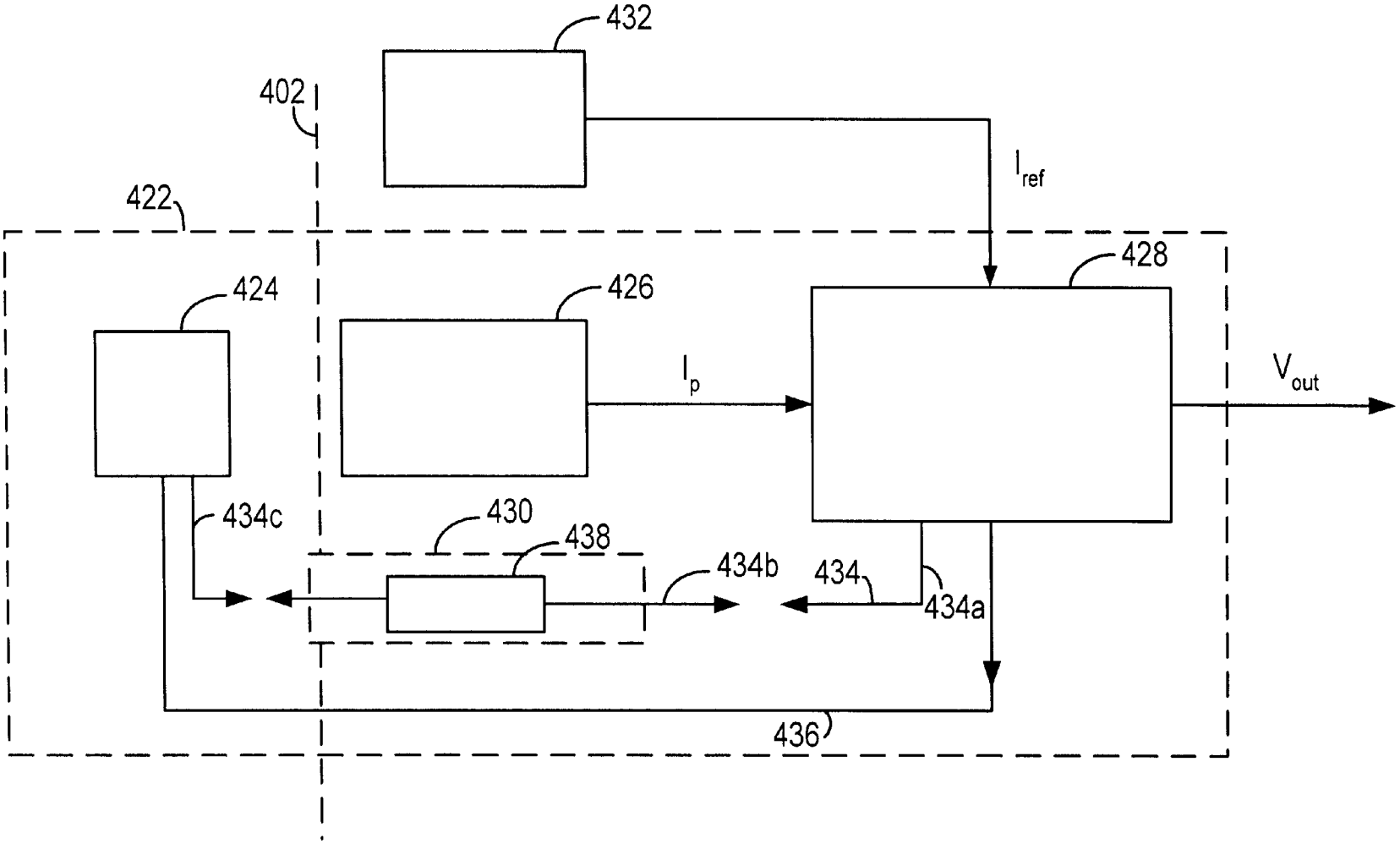
FIG. 4 is a block diagram of a densitometer having a diagnostic system according to a second embodiment.

FIG. 4 is a block diagram of a densitometer 422 having a densitometer diagnostic system according to a second embodiment. The densitometer 422 is essentially the same as the densitometer described in the first embodiment and in FIGS. 2–3, having a collector 426 and a current source 432 and operatively disposed next to a photoconductor 402. However, the diagnostic circuitry 430 comprises a second current limiting resistor 438 and the second segment 434*b* of the first wire 434. The second wire 436 is not segmented, but rather connects the amplifier circuitry 428 directly to the emitter 424. As previously discussed, the second current limiting resistor 438 preferably is a single resister, but may be multiple resisters and any suitable current limiting circuitry. The first segment 434*a* and the third segment of 434*b* have sufficient length to connect when the diagnostic circuitry 430 is removed from the densitometer 422.

Figure 5:
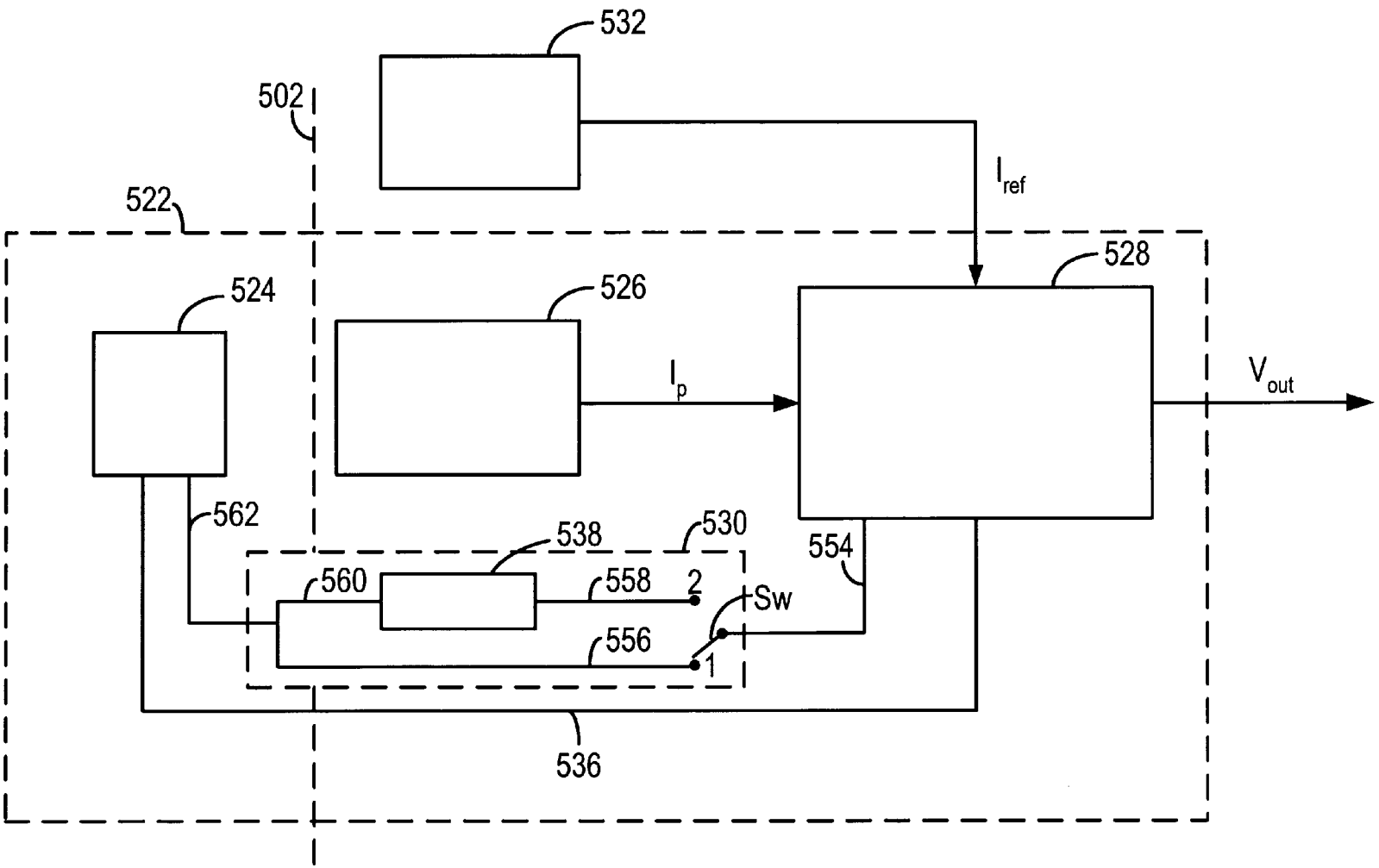
FIG. 5 is a block diagram of a densitometer having a diagnostic system according to a third embodiment.

FIG. 5 is a block diagram of a densitometer 522 having a densitometer diagnostic system according to a third embodiment. The densitometer 522 is essentially the same as the densitometers described in the first and second embodiments and in FIGS. 2–4, having a collector 526 and a current source 532 and operatively disposed next to a photoconductor 502. However, the diagnostic circuitry 530 is not removable, but rather remains in the densitometer even when no diagnostic testing performed. The second wire 536 is not segmented, but rather connects the amplifier circuitry 528 directly to the emitter 524.

The diagnostic circuitry 530 comprises current limiting circuitry 538, a switch Sw, a jumper wire 556, a first circuit wire 558, and a second circuit wire 560. Similar to the first and second embodiments, the current limiting circuitry 538 may be a single resister and may be multiple resisters. An amplifier circuit wire 554 connects the amplifier circuitry 528 to the switch Sw, which operates between switch pin 1 and switch pin 2. The jumper wire 556 connects switch pin 1 to the emitter wire 562, which connects to the emitter 524. The first circuit wire 558 connects the switch pin 2 to the current limiting circuitry 538. The second circuit wire 560 connects the circuit limiting circuitry 538 to the emitter wire 562.

When no diagnostic testing is performed, the switch Sw is in the switch pin 1 position. The jumper wire 556 effectively bypasses the current limiting circuitry 538. When diagnostic testing is performed, the switch Sw is in the switch pin 2 position. The current limiting circuitry 538 is activated to reduce the current and consequently the output voltage $V_{out}$ as described in the first and second embodiments. As previously discussed, the current limiting circuitry 538 preferably reduces the power output of the emitter 524 in the range of about 35 percent through 65 percent. In one aspect, the current limiting circuitry 538 reduces the power output of the emitter 524 by about 50 percent. The switch Sw may be any suitable switch device and may be manually operated, but is preferably electronically controlled by the logic and control unit (LCU).

Figure 6:
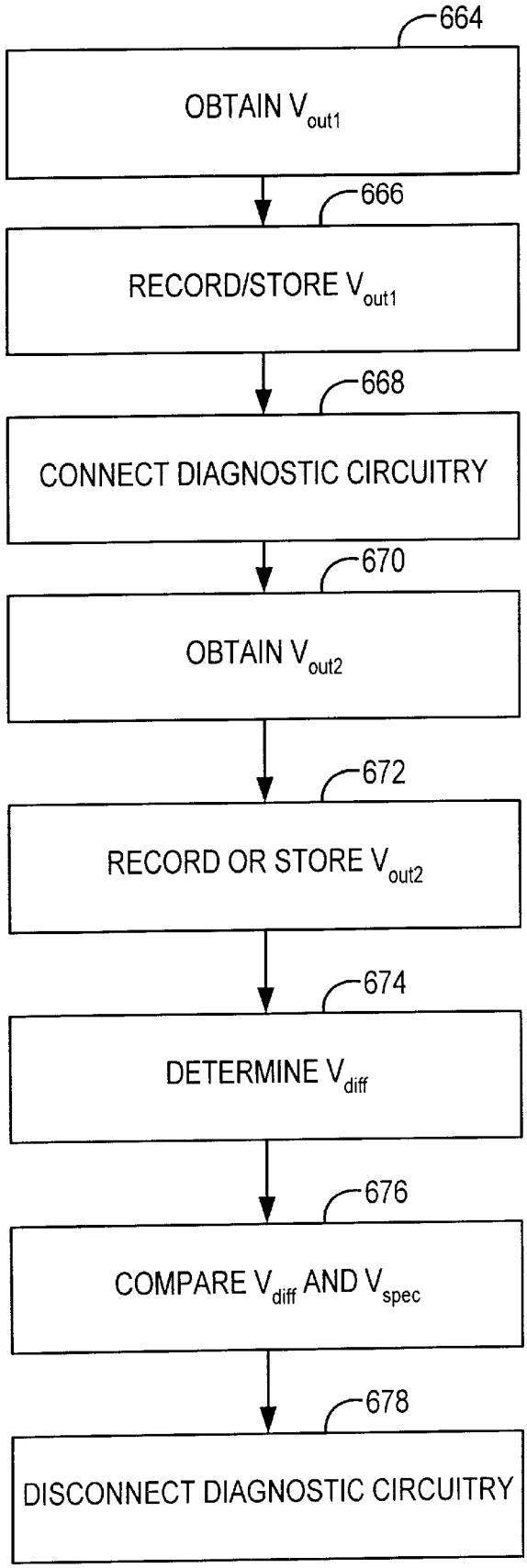
FIG. 6 is a flowchart of a method for diagnostic testing of a densitometer in an image-forming machine.

FIG. 6 is a flowchart of a method for diagnostic testing of a densitometer for an image-forming machine. As previously described, a densitometer obtains 664 a first output voltage $V_{out1}$ reading of the photoconductor. A portion of the photoconductor preferably without toner is positioned in the optical path of the emitter and the collector. The densitometer operates to provide the first output voltage $V_{out1}$ reading. The first output voltage $V_{out1}$ reading is recorded or stored 666. Diagnostic circuitry is connected 668 to the densitometer. The diagnostic circuitry may be a "plug-in" type as described in the first, second, or similar embodiments. The diagnostic circuitry may be part of or connected to the densitometer as described in the third or a similar embodiment. The densitometer obtains 670 a second output voltage $V_{out2}$ reading of the photoconductor. The second output voltage $V_{out2}$ reading is stored or recorded 672. An output voltage difference $V_{diff}$ reading is determined 674. The first output voltage $V_{out1}$ reading is compared to the second output voltage $V_{out2}$ reading. Preferably, the first output voltage $V_{out1}$ reading is subtracted from the second output voltage $V_{out2}$ reading to provide the output voltage difference $V_{diff}$ reading. The output voltage difference $V_{diff}$ reading is compared 676 to an output voltage specification $V_{spec}$ reading. In one aspect, the densitometer components are functional when the output voltage difference $V_{diff}$ reading is the same value or is within a range of values as the output voltage specification $V_{spec}$ reading. The output voltage specification $V_{spec}$ reading depends upon the densitometer and the diagnostic circuitry used. The diagnostic circuitry is disconnected 678 from the densitometer. Alternatively, the diagnostic circuitry may be disconnected after the second output voltage $V_{out2}$ reading is determined in 670.

Figure 7:
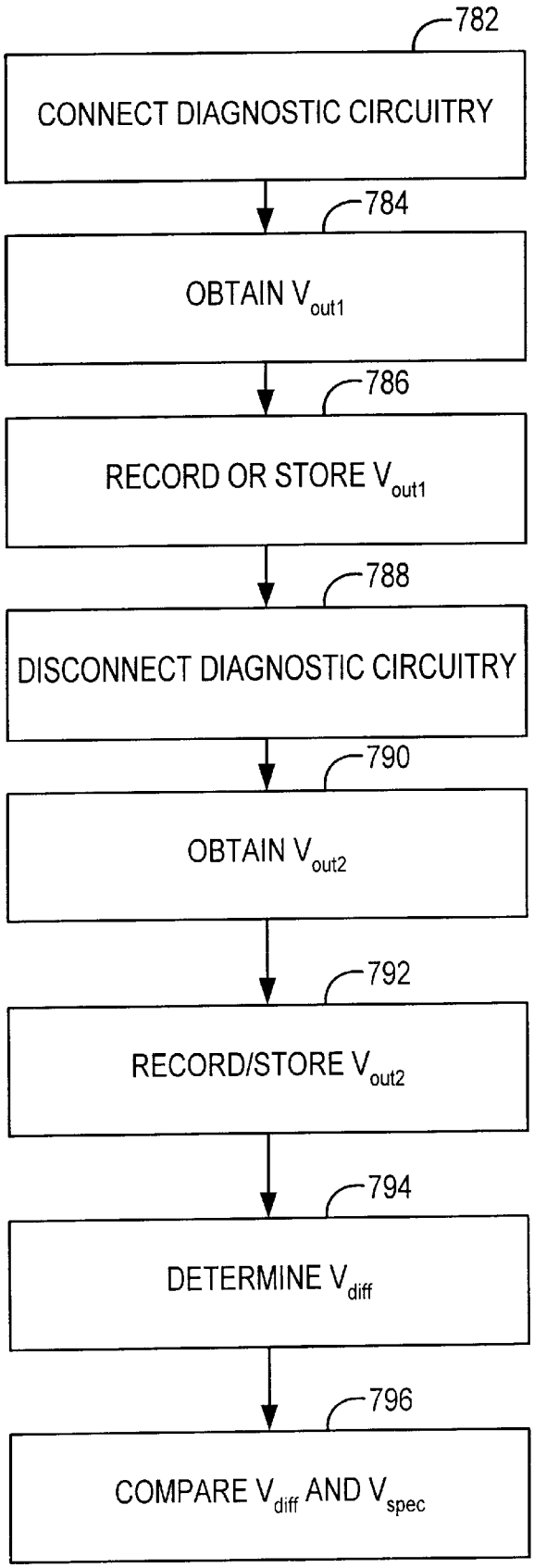
FIG. 7 is a flowchart of an alternate method for diagnostic testing of a densitometer in an image-forming machine.

FIG. 7 is a flowchart of an alternate method for diagnostic testing of a densitometer for an image-forming machine. Diagnostic circuitry is connected 782 to the densitometer. The diagnostic circuitry may be a "plug-in" type as described in the first, second, or similar embodiments. The diagnostic circuitry may be part of or connected to the densitometer as described in the third or a similar embodiment. A portion of the photoconductor preferably without toner is positioned in the optical path of the emitter and the collector. The densitometer obtains 784 a first output voltage $V_{out1}$ of the photoconductor. The first output voltage $V_{out1}$ is stored or recorded 786. The diagnostic circuitry is disconnected 788 from the densitometer. The densitometer obtains 790 a second output voltage $V_{out2}$ of the photoconductor. The second output voltage $V_{out2}$ is recorded or stored 792. An output voltage difference $V_{diff}$ is determined 794. The first output voltage $V_{out1}$ is compared to the second output voltage $V_{out2}$ Preferably, the second output voltage $V_{out2}$ is subtracted from the first output voltage $V_{out1}$ to provide the output voltage difference $V_{diff}$. The output voltage difference $V_{diff}$ is compared 796 to an output voltage specification $V_{spec}$. As discussed, the densitometer components are functional when the output voltage difference $V_{diff}$ is the same value or is within a range of values as the output voltage specification $V_{spec}$. The output voltage specification $V_{spec}$ depends upon the densitometer and the diagnostic circuitry used.

Various embodiments of the invention have been described and illustrated. However, the description and illustrations are by way of example only. Many more embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. An image-forming machine with a densitometer diagnostic system, comprising:

a photoconductor;

at least one charger operatively disposed to electrostatically charge the photoconductor;

an exposure machine operatively disposed to optically expose and form an electrostatic image on the photoconductor;

a toning station operatively disposed to apply toner on the photoconductor, the toner having a charge to adhere to the electrostatic image; and a densitometer having an emitter and a collector operatively disposed adjacent to the photoconductor, the collector to collect emissions from the emitter, amplifier circuitry electrically connected to provide a voltage supply to the emitter and to receive a current signal from the collector, the amplifier circuitry to provide at least one output voltage based on the current signal, and diagnostic circuitry operatively disposed to connect to the amplifier circuitry and the emitter, the diagnostic circuitry to reduce a drive current to the emitter.

2. An image-forming machine according to claim 1, further comprising a current source to provide a reference current to the amplifier circuitry.

3. An image-forming machine according to claim 2, where the amplifier circuitry determines the at least one output voltage based on a comparison of the current signal and the reference current.

4. An image-forming machine according to claim 1, further comprising a logic control unit, where the amplifier circuitry provides the at least one output voltage to the logic control unit.

5. An image-forming machine according to claim 4, where the at least one output voltage comprises a first output voltage and a second output voltage, the first output voltage provided when the diagnostic circuitry is connected, the second output voltage provided when the diagnostic circuitry is disconnected.

6. An image-forming machine according to claim 5, where the logic control unit compares the first and second output voltages to determine a output voltage difference.

7. An image-forming machine according to claim 6, where the logic control unit compares the output voltage difference with an output voltage specification.

8. An image-forming machine according to claim 1, where the diagnostic circuitry reduces the drive current in the range of about 35 percent through about 65 percent.

9. An image-forming machine according to claim 1, where the diagnostic circuitry reduces the drive current about 50 percent.

10. A diagnostic system for a densitometer according to claim 1, where the diagnostic circuitry comprises current limiting circuitry.

11. An image-forming machine according to claim 1, where the diagnostic circuitry comprises a current limiting resister.

12. An image-forming machine according to claim 11, where the current limiting resister provides resistance in the range of about 100 Ω through about 200 Ω and operates in the range of about 0.25 W through about 2W.

13. An image-forming machine according to claim 11, where the current limiting resister provides resistance of about 150 Ω and operates at about 1 W.

14. An image-forming machine according to claim 1, where the amplifier circuitry comprises a first current limiting resister, and where the diagnostic circuitry comprises a second current limiting resister.

15. An image-forming machine according to claim 1, further comprising a switch to connect and disconnect the diagnostic circuitry.

16. An image-forming machine according to claim 1, where the diagnostic circuitry is removable from the densitometer.

17. A densitometer diagnostic system for an image-forming machine, comprising:

an emitter;

a collector operatively disposed to collect emissions from the emitter;

amplifier circuitry electrically connected to provide a voltage supply to the emitter and to receive a current signal from the collector, the amplifier circuitry to provide at least one output voltage based on the current signal; and diagnostic circuitry operatively disposed to connect to the amplifier circuitry and the emitter, the diagnostic circuitry to reduce a drive current to the emitter.

18. A densitometer diagnostic system according to claim 17, further comprising a current source to provide a reference current to the amplifier circuitry.

19. A densitometer diagnostic system according to claim 18, where the amplifier circuitry determines the at least one output voltage based on a comparison of the current signal and the reference current.

20. A densitometer diagnostic system according to claim 17, where the amplifier circuitry provides a first output voltage when the diagnostic circuitry is connected, and where the amplifier circuitry provides a second output voltage when the diagnostic circuitry is disconnected.

21. A densitometer diagnostic system according to claim 17, where the diagnostic circuitry comprises current limiting circuitry.

22. A densitometer diagnostic system according to claim 17, where the diagnostic circuitry comprises a current limiting resister.

23. A densitometer diagnostic system according to claim 22, where the current limiting resister provides resistance in the range of about 100 Ω through about 200 Ω and operates in the range of about 0.25 W through about 2W.

24. A densitometer diagnostic system according to claim 22, where the current limiting resister provides resistance of about 150 and operates at about 1 W.

25. A densitometer diagnostic system according to claim 17, where the amplifier circuitry comprises a first current limiting resister and the diagnostic circuitry comprises a second current limiting resister.

26. A densitometer diagnostic system according to claim 17, further comprising a switch to connect and disconnect the diagnostic circuitry.

27. A densitometer diagnostic system according to claim 17, where the diagnostic circuitry is removable from the densitometer.

28. A densitometer diagnostic system according to claim 17, where the emitter is one of a light emitting diode (LED) and an infrared emitting diode (IRED).

29. A method for diagnostic testing of a densitometer in an image-forming machine having a photoconductor, comprising the steps:

(a) obtaining a first output voltage from the densitometer for the photo conductor;

(b) connecting diagnostic circuitry to the densitometer;

(c) obtaining a second output voltage from the densitometer for the photoconductor;

(d) determining an output voltage difference from the first and second output voltages; and (e) comparing the output voltage difference to an output voltage specification.

30. A method for diagnostic testing according to claim 29, where at least one of steps (a) and (c) further comprises the substep of storing one of the first and second output voltages.

31. A method for diagnostic testing according to claim 29, further comprising the step of disconnecting the diagnostic circuitry after step (c).

32. A method for diagnostic testing according to claim 29, where step (d) further comprises the substep of subtracting the first output voltage from the second output voltage to determine the output voltage difference.

33. A method for diagnostic testing according to claim 29, wherein the diagnostic circuitry comprises a current limiting resistor.

34. A method for diagnostic testing according to claim 29, wherein the diagnostic circuitry is removable from the densitometer.

35. A method for diagnostic testing of a densitometer in an image-forming machine having a photoconductor, comprising the steps:

(a) connecting diagnostic circuitry to the densitometer;

(b) obtaining a first output voltage from the densitometer for the photoconductor;

(c) disconnecting the diagnostic circuitry from the densitometer;

(d) obtaining a second output voltage from the densitometer for the photo conductor;

(e) determining an output voltage difference from the first and second output voltages; and (f) comparing the output voltage difference to an output voltage specification.

36. A Method for diagnostic testing according to claim 35, where at least one of step (b) and (d) further comprises the substep of storing one of the first and second output voltages.

37. A method for diagnostic testing according to claim 35, where step (e) further comprises the substep of subtracting the second output voltage from the first output voltage to determine the output voltage difference.

38. A method for diagnostic testing according to claim 35, wherein the diagnostic circuitry comprises a current limiting resistor.

39. A method for diagnostic testing according to claim 35, wherein the diagnostic circuitry is removable from the densitometer.

* * * * *